US010670364B1

(12) United States Patent
Rients

(10) Patent No.: US 10,670,364 B1
(45) Date of Patent: Jun. 2, 2020

(54) FIREARM RECEIVER

(71) Applicant: Cody Lee Rients, South Salt Lake, UT (US)

(72) Inventor: Cody Lee Rients, South Salt Lake, UT (US)

( * ) Notice: Subject to any disclaimer, the term of this patent is extended or adjusted under 35 U.S.C. 154(b) by 0 days.

(21) Appl. No.: 16/239,481

(22) Filed: Jan. 3, 2019

(51) Int. Cl.
*F41A 21/48* (2006.01)

(52) U.S. Cl.
CPC ..... *F41A 21/485* (2013.01)

(58) Field of Classification Search
CPC ..... F41A 21/48; F41A 21/484; F41A 21/485
USPC ..... 42/75.01, 75.02
See application file for complete search history.

(56) References Cited

U.S. PATENT DOCUMENTS 3,412,641 A * 11/1968 Biehl ..... F41F 3/045 89/1.812
3,731,418 A * 5/1973 Birkenhagen ..... F41A 21/481 42/75.02
5,343,650 A * 9/1994 Swan ..... F41C 23/16 42/117
2005/0188584 A1* 9/2005 Orth ..... F41A 11/04 42/71.01
2005/0229463 A1* 10/2005 Tashjian ..... F41A 3/66 42/75.02
2006/0236582 A1* 10/2006 Lewis ..... F41A 3/26 42/73
2010/0162608 A1* 7/2010 McCann ..... F41C 23/14 42/71.01
2013/0219765 A1* 8/2013 Ibarguren ..... F41A 21/485 42/75.02
2014/0165444 A1* 6/2014 Masters ..... F41A 21/484 42/75.02
2015/0323267 A1* 11/2015 Donnelly ..... F41A 3/54 89/139
2019/0113297 A1* 4/2019 Turlakov ..... F41A 21/485

OTHER PUBLICATIONS

Desert Tech, "How your SRS A1 Sniper Rifile is made! Disassembly and Assembly", YouTube video published Jan. 5, 2013 available at the link https://yputu.be/WbZPWuLG0L8?t=116 retrieved Jan. 1, 2019 at 21:10 MST. The video, a screenshot of which is included hereinafter, shows a previously existing receiver body with a tightening slot and fasteners.

* cited by examiner

*Primary Examiner* — Bret Hayes

(57) ABSTRACT

A receiver body is provided herein having a plurality of barrel-tightening portions with at least one relief recess therebetween and relief recesses defined in the body on either proximal end. The relief recesses and barrel-tightening portions are sized to allow the barrel-tightening portions to be tightened and loosened independently of each other.

18 Claims, 6 Drawing Sheets

FIREARM RECEIVER

BACKGROUND

Firearms include a receiver, an action, a trigger mechanism, and a barrel. The barrel is often threaded to one end of the receiver. The manner in which the barrel is secured to the receiver may result in significant variations in the amount of stress at the coupling locations as well as variations of stress at other locations within the receiver. Significant variations in stress and/or strain may cause shortened functional life of the firearm or degradations in accuracy.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

A firearm receiver includes a receiver body having a proximal end, a distal end, and a barrel receiving recess defined in the second end and extending proximally therefrom. The barrel receiving recess defines a central axis. The receiver body also includes a first barrel-tightening portion formed on an outer portion of the receiver body, the first barrel-tightening portion having a first partial tightening slot defined therein, the first partial tightening slot being in communication with the barrel receiving recess and having first opposing sidewalls. The receiver body also includes a second barrel-tightening portion formed on an outer portion of the receiver body, the second barrel-tightening portion having a second partial tightening slot defined therein, the second partial tightening slot being in communication with the barrel receiving recess and having second opposing sidewalls. A first relief recess is defined in the outer portion of the receiver body at least partially between the first barrel-tightening portion and the second barrel-tightening portion, the first relief recess being in communication with each of the first partial tightening slot and the second partial tightening slot, the first relief recess being wider than both the first tightening slot and the second partial tightening slot. The receiver body also includes a second relief recess defined in the outer portion of the receiver body proximally of the first barrel-tightening portion, the second relief recess being in communication with the first partial tightening slot and being wider than the first partial tightening slot. The receiver body also includes a third relief recess defined in the outer portion of the receiver body distally to the second barrel-tightening portion, the third relief recess being in communication with the second partial tightening slot and being wider than the second partial tightening slot in which the first relief recess, the second relief recess, and the third relief recess are sized to allow the first opposing sidewalls to move relative to each other independently of movement of the second opposing sidewalls relative to each other.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Receiver assemblies, receiver bodies, firearm incorporating the like and methods of forming the same are provided herein. The receiver body is configured to allow the barrel-tightening portions to function relatively independently of each other. In particular, the relief recesses result in voids near the barrel-tightening portions to reduce the amount of material that is deflected as the barrel-tightening portions are engaged (with a corresponding reduction in stress) while still providing sufficient reinforcement for the fasteners to provide the desired clamping force on the barrel. Reducing the amount of material deflected to engage the barrel-tightening portions reduces the stress transmitted to adjacent regions thereby providing relatively even clamping forces across the barrel-tightening portions at a given torque loading on the fasteners. Similarly, since the relief recesses reduce the deflection and strain transmitted to those regions near or adjacent the barrel-tightening portions, more of the force and torque used to engage the barrel-tightening portions acts therethrough, resulting in higher barrel clamping forces for given torque loads. Simultaneously increasing the clamping force applied by each barrel-tightening portion while also evening the clamping force applied by each barrel-tightening portion for the same applied torque has shown significant improvement in the accuracy of firearms making use of such receivers.

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
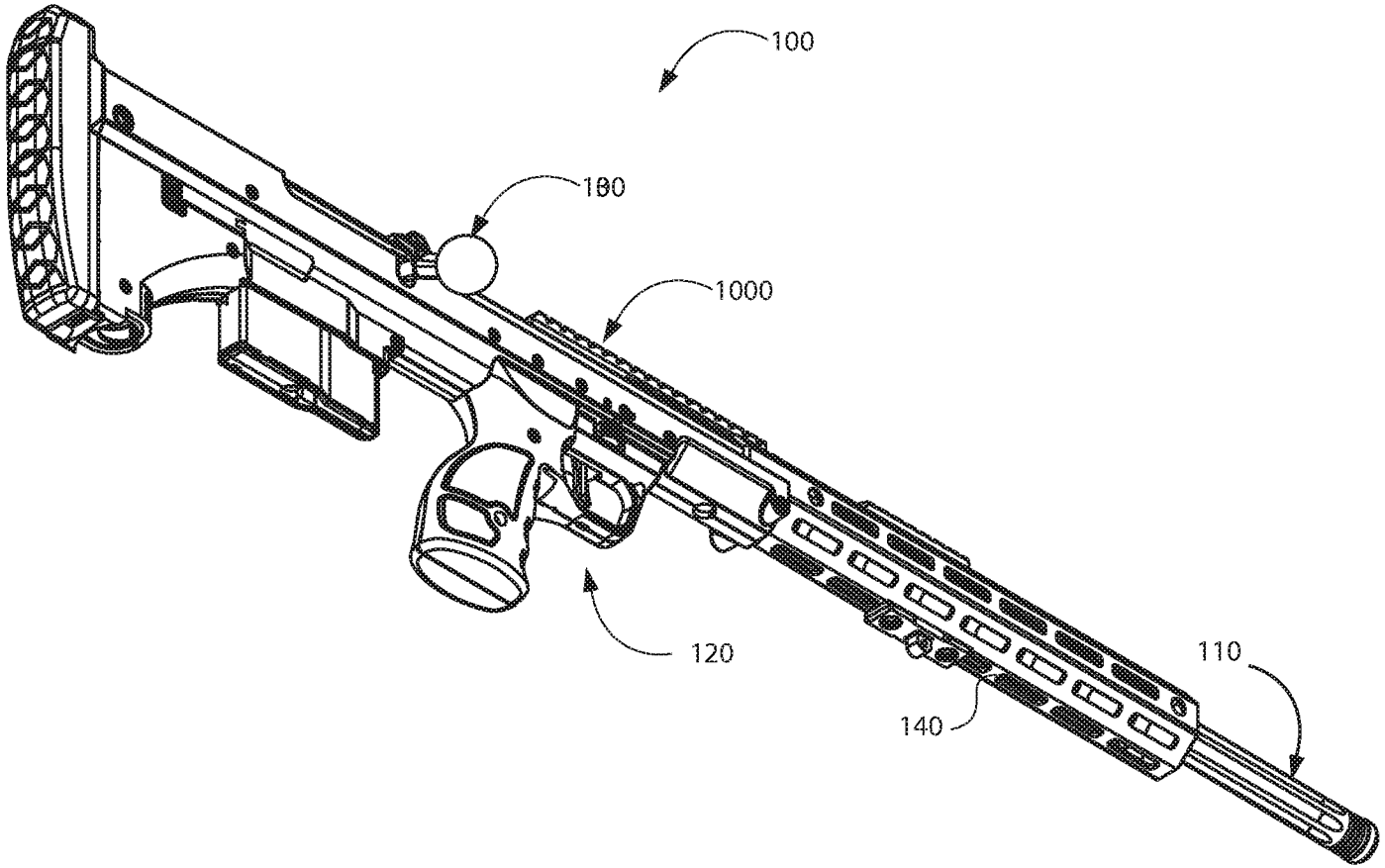
FIG. 1A illustrates a perspective view of an assembled firearm according to one example.

FIG. 1A is a perspective view of a firearm 100. As illustrated in FIG. 1A, the firearm 100 may be configured as a rifle, and as a bolt-action rifle in particular, though it will be appreciated that the firearm 100 may have other configurations. The firearm 100 includes a barrel assembly 110, a stock assembly 120, and an action 130 each coupled to a receiver assembly 1000. While the stock assembly 120 is shown as being separate from the receiver assembly 1000, it will be appreciated that in other examples the stock assembly 120 and/or any of the components shown coupled thereto may be directly coupled to and/or integrated with the receiver assembly 1000.

Figure 1B:
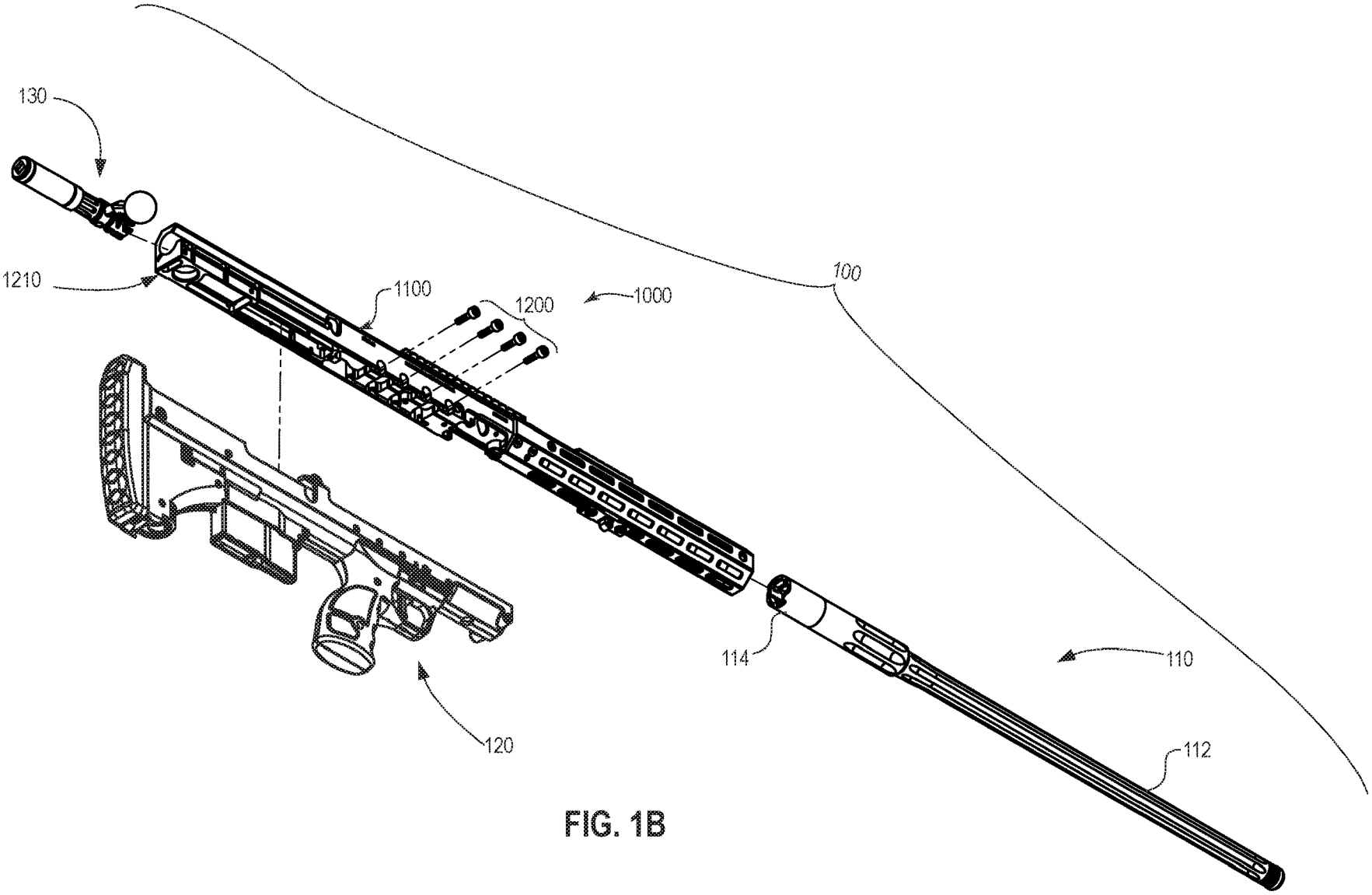
FIG. 1B illustrates an exploded view of the firearm of FIG. 1A.

As shown in FIG. 1B, the receiver assembly 1000 generally includes a receiver body 1100 and a plurality of fasteners 1200. As will be discussed in more detail at an appropriate point hereinafter, the fasteners 1200 are coupled to the receiver body 1100 in such a manner that when the barrel assembly 110 is in place relative to the receiver assembly 1000, the fasteners 1200 may be tightened to the receiver body 1100 to thereby secure the barrel assembly 110 in place. Such a configuration may allow the barrel assembly 110 to be removably coupled to the receiver assembly 1000, which in turn may allow different barrel assemblies to be coupled to the receiver assembly 1000, thereby allowing the firearm 100 to be configured as a multi-barrel and/or multi-caliber. As will also be discussed in more detail at an appropriate point hereinafter, the receiver body 1100 is configured such that applying a given torque to the fasteners 1200 results in substantially similar deflection of the receiver body 1100 adjacent the fasteners 1200, which may result in relatively even stress within the receiver body 1100 while transmitting even clamping forces to the barrel assembly 110.

With the barrel assembly 110 securely coupled to the receiver assembly 1000, the assembly 1000 also facilitates cycling of the action 130 relative to the barrel assembly 110 to feed, fire, and extract cartridges by having the action 130 slidingly coupled to the receiver body 1100 as is known in the art.

In the illustrated example, a fore end 140 is coupled to the receiver assembly 1000. While the fore end 140 is shown and described as being removably coupled to the receiver body 1100, it will be appreciated that in other examples the fore end 140 may be integrally formed with the receiver body 1100.

FIG. 1B is an exploded view of the firearm 100. As introduced, the receiver 1100 is configured to have the barrel assembly 110 coupled thereto. In the illustrated example, the barrel assembly 110 generally includes a barrel 112 and a barrel extension 114 coupled to a barrel 112. In at least one example, the barrel extension 114 facilitates coupling of the receiver body 1100 to the barrel 112 and further facilitates coupling the action 130 when the barrel assembly 110 is secured to the receiver assembly 1000. It will be appreciated that the barrel extension 114 may be integrally formed with the barrel 112 in some examples.

Figure 2A:
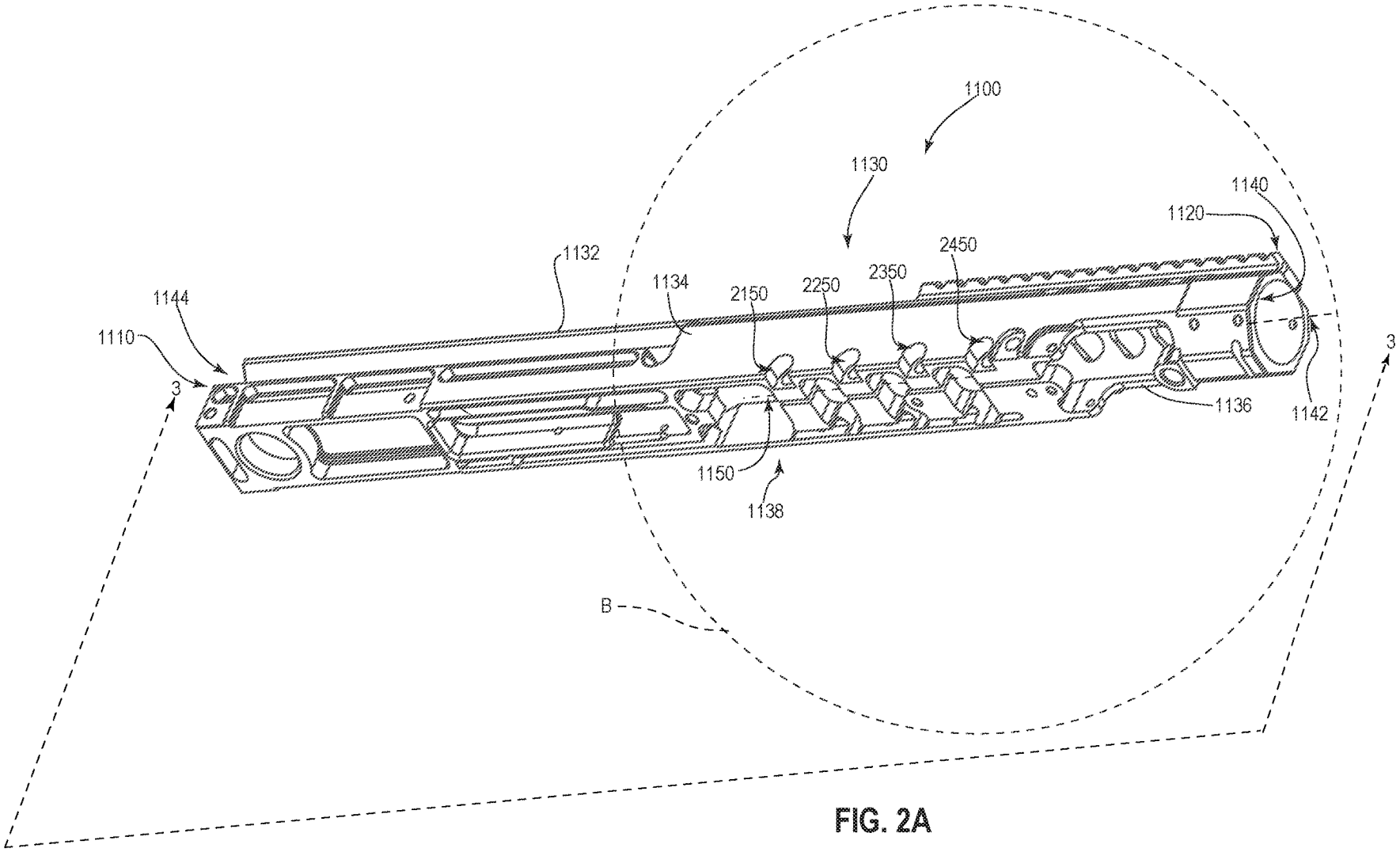
FIG. 2A illustrates an isolated view of the receiver body of the firearm shown in FIGS. 1A-1B.

FIG. 2A is an isolated perspective view of the receiver body 1100. In the illustrated example, the receiver assembly 1000 includes a receiver body 1100 having a first end 1110 and a second end 1120. Various components and parts will be described with reference to their relative proximity to the rear portion such that parts or components that are closer the first end 1110 of the receiver will be described as proximal (such as more proximal to an intended operator) or rearward while parts or components that are relatively more distant from the first end 1110 will be described as being distal (such as distal to an intended operator) or forward. Similarly, movement toward the first end 1110 will be described as rearward movement while movement away from the first end 1110 will be described as forward movement.

As shown in FIG. 2A, the receiver body 1100 has an outer portion 1130 that generally includes a top portion 1132, side portions 1134, 1136, and a bottom portion 1138. A barrel-receiving recess 1140 defined in the receiver body 1100. The barrel receiving recess 1140 extends proximally from the second end 1120 of the receiver body 1100. The barrel receiving recess 1140 defines a central axis 1142 of the receiver body 1100. A bolt receiving recess 1144 is defined in the receiver body 1100, and in the first end 1110 of the receiver body 1100 in particular. Depths described herein will be described with reference to the central axis 1142. In particular parts, components, or surfaces that are relatively closer to the central axis 1142 will be described as being deeper then components, parts, surfaces or the like that are not as close, especially when such features or components can be characterized or described relative to the outer portion 1130 of the receiver body 1100.

In the example illustrated in FIG. 2A, the bolt receiving recess 1144 extends distally from the first end 1110 of the body and into communication with the barrel receiving recess 1140. The barrel receiving recess 1140 and the bolt receiving recess 1144 together define a plurality of surfaces that may be collectively referred to as an inner portion of the receiver body 1100. It will be appreciated that the various recesses defined in the receiver body 1100 may have other shapes and configurations without departing from the present invention.

Figure 2B:
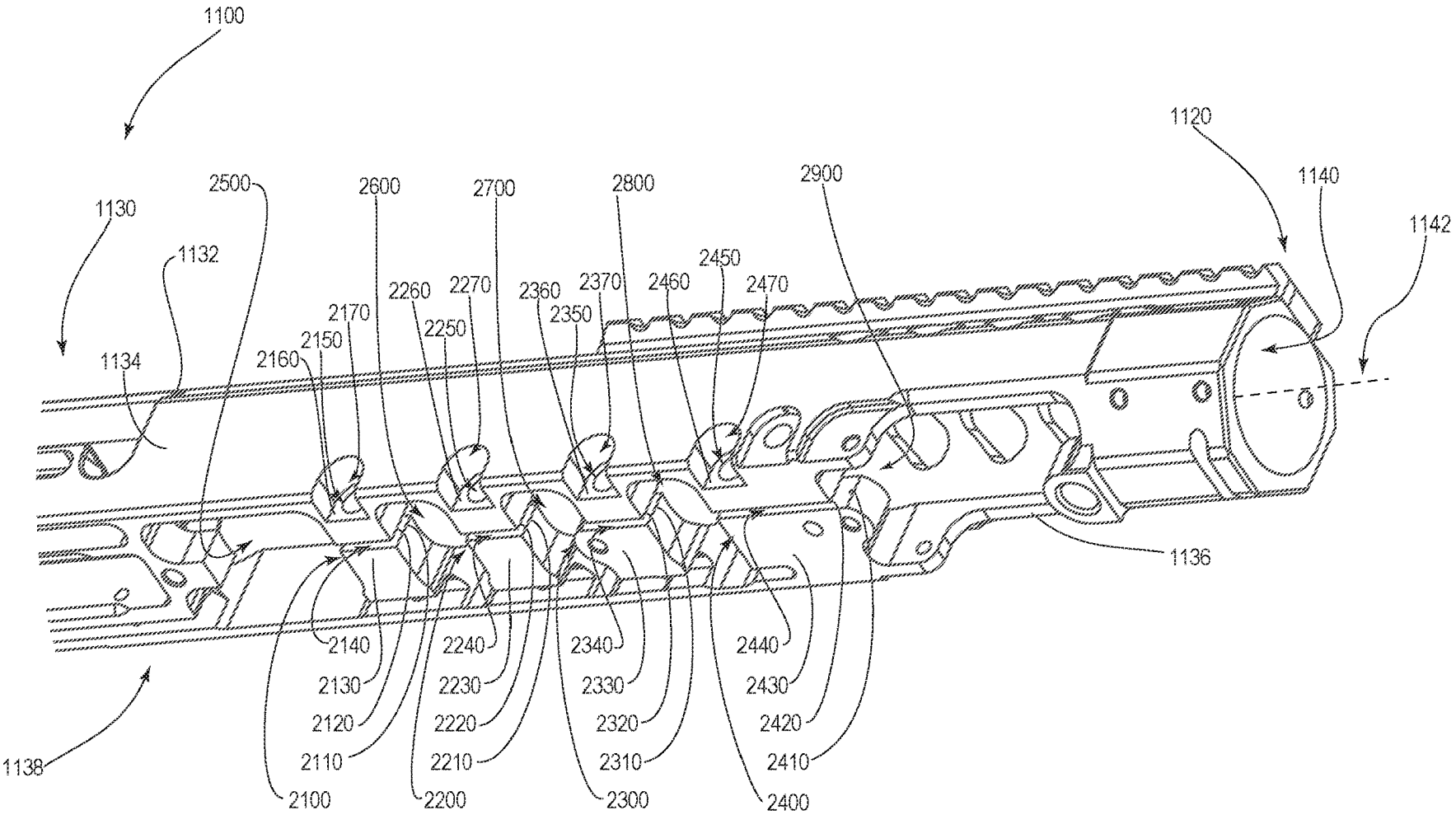
FIG. 2B illustrates a detailed view of portion B of FIG. 2A.

As shown in FIG. 2B, the receiver body 1100 also includes a plurality of barrel-tightening portions, including a first barrel-tightening portion 2100, a second barrel-tightening portion 2200, a third barrel-tightening portion 2300, and a fourth barrel-tightening portion 2400. The barrel-tightening portions 2100, 2200, 2300, 2400 are formed on the outer portion 1130 of the receiver body 1100.

The first barrel-tightening portion 2100 includes opposing first sidewalls 2110, 2120 each extending inwardly from a first outer tightening portion 2130 toward the central axis 1142. The opposing first sidewalls 2110, 2120 define a first partial tightening slot 2140 therebetween that is in communication with the barrel receiving recess 1140.

The second barrel-tightening portion 2200 includes opposing second sidewalls 2210, 2220 each extending inwardly from a second outer tightening portion 2230 toward the central axis 1142. The opposing second sidewalls 2210, 2220 define a second partial tightening slot 2240 therebetween that is in communication with the barrel receiving recess 1140.

The third barrel-tightening portion 2300 includes opposing third sidewalls 2310, 2320 each extending inwardly from a third outer tightening portion 2330 toward the central axis 1142. The opposing third sidewalls 2310, 2320 define a third partial tightening slot 2340 therebetween that is in communication with the barrel receiving recess 1140.

The fourth barrel-tightening portion 2400 includes opposing fourth sidewalls 2410, 2420 each extending inwardly from a fourth outer tightening portion 2430 toward the central axis 1142. The opposing fourth sidewalls 2410, 2420 define a fourth partial tightening slot 2440 therebetween that is in communication with the barrel receiving recess 1140. The first, second, third, and fourth partial tightening slots 2410, 2420, 2430, 2440 may be part of a single tightening slot that is then selectively relieved with various relief recesses, described below. The first, second, third, and fourth partial tightening slots 2410, 2420, 2430, 2440 are described separately for ease of reference in describing the finished receiver body 1100 shown in the FIGS. It will be appreciated that the first, second, third, and fourth partial tightening slots 2410, 2420, 2430, 2440 may be part of a single tightening slot that is in communication with or widened by the relief recesses described hereinafter.

The receiver body 1100 also includes a plurality of relief recesses defined therein. As shown in FIG. 2B, relief recesses may include a first end relief 2500, a central relief recess 2600, a second central relief recess 2700, a third central relief recess 2800, and a second end relief recess 2900 (sometimes collectively referred to as relief recesses 2500, 2600, 2700, 2800, 2900), each defined in the receiver body 1100 and in the bottom portion 1138 thereof in particular. The numbering and description of end or central is merely for ease of reference in describing the configuration and the reference as first, second, etc., in the description is merely for consistency within the detailed description and should not be construed as limiting the position, order, number or nature of any of the relief recesses generally as the specific requirement are set forth in the claims.

In the illustrated example, the first end relief recess 2500 is positioned proximally of the first tightening portion 2100 while the second end relief recess 2900 is positioned distally of the fourth tightening portion 2400. The terminal ends of each of the relief recesses described herein occur where the void in the receiver body 1100 adjacent the first, second, third, or fourth barrel-tightening portions 2100, 2200, 2300, 2400 widen relative to the average width of the first, second, third, and fourth partial tightening slots 2410, 2420, 2430, 2440 respectively. Consequently, each of the relief recesses 2500, 2600, 2700, 2800, 2900 are wider than either of the adjacent first, second, third, and fourth partial tightening slots 2410, 2420, 2430, 2440.

The central relief recesses, including the first central relief recess 2600, the second central relief recess 2700, and the third central relief recess 2800 are positioned at least partially between the first tightening portion 2100 and the fourth tightening portion 2400. More specifically, the first central relief recess 2600 is positioned at least partially between the first tightening portion 2100 and the second tightening portion 2200, the second central relief recess 2700 is positioned at least partially between the second tightening portion 2200 and the third tightening portion 2300, and the third central relief portion 2800 is positioned at least partially between the third tightening portion 2300 and the fourth tightening portion 2400.

As will be discussed in more detail hereinafter, the configuration of the first end relief recess 2500, the first central relief recess 2600, the second central relief recess 2700, the third central relief recess 2800, and the second end relief recess 2900 allow the first opposing sidewalls 2110, 2120, the second opposing sidewalls 2210, 2220, the third opposing sidewalls 2310, 2320, and the fourth opposing sidewalls 2410, 2420 to move with respect to each other independently, which may provide relatively even clamping forces and clamping stress within the first, second, third, and fourth tightening portions 2100, 2200, 2300, 2400. The first opposing sidewalls 2110, 2120, the second opposing sidewalls 2210, 2220, the third opposing sidewalls 2310, 2320, and the fourth opposing sidewalls 2410, 2420 each have a default distance therebetween when no compressive or expansive forces are applied thereto.

Accordingly, referring simultaneously to FIGS. 1B and 2B, the receiver body 1100 has multiple barrel-tightening portions 2100, 2200, 2300, 2400 that are engaged by cooperating with fasteners 1200 as the fasteners 1200 are tightened or disengaged as the fasteners 1200 loosened to selectively narrow or widen the partial tightening slots 2140, 2240, 2340, 2440 to thereby tighten or loosen the barrel-tightening portions 2100, 2200, 2300, 2400 to the barrel 112.

The receiver body 1100 is configured to allow the barrel-tightening portions (2100, 2200, 2300, 2400, FIGS. 2A-2B) to function relatively independently of each other. In particular, the relief recesses 2500, 2600, 2700, 2800, 2900 result in voids near the barrel-tightening portions 2100, 2200, 2300, 2400 to reduce the amount of material that is deflected as the barrel-tightening portions 2100, 2200, 2300, 2400 are engaged (with a corresponding reduction in stress) while still providing sufficient reinforcement for the fasteners 1200 to provide the desired clamping force on the barrel 120. Reducing the amount of material deflected to engage the barrel-tightening portions 2100, 2200, 2300, 2400 reduces the stress transmitted to adjacent regions thereby providing relatively even clamping forces across the barrel-tightening portions 2100, 2200, 2300, 2400 at a given torque loading on the fasteners 1200. In one example, at a torque load of approximately 80 ft/lbs, the deflection for the first, second, third and fourth barrel-tightening portions 2100, 2200, 2300, 2400 to narrow the first, second, third, and fourth partial tightening slots 2150, 2250, 2350, 2450 were each approximately 0.032 inches+/−0.001 inches of deflection for a variance of about 3% compared to other tested configurations that did not have relief recessed defined therein as set forth in the present application had less than half the deflection and more than 7% variance given at the same torque loading. Accordingly, since the relief recesses 2500, 2600, 2700, 2800, 2900 reduce the deflection and strain transmitted to the regions near or adjacent the barrel-tightening portions 2100, 2200, 2300, 2400, more of the force and torque used to engage the barrel-tightening portions 2100, 2200, 2300, 2400 acts therethrough, resulting in higher barrel clamping forces for given torque loads. Simultaneously increasing the clamping force applied by each barrel-tightening portion while also evening the clamping force applied by each barrel-tightening portion for the same applied torque has shown significant improvement of firearms making use of such receivers.

As shown in FIG. 2B, the receiver body 1100 also includes fastener channels defined therein, including a first fastener channel 2150, a second fastener channel 2250, a third fastener channel 2350, and a fourth fastener channel 2450. In the illustrated example, each of the fastener channel 2150, the second fastener channel 2250, the third fastener channel 2350, and the fourth fastener channel 2450 are formed in the side 1134 of the receiver body 1100 near the bottom portion 1138 of the receiver body 1100. In particular, the first fastener channel 2150 is defined in the first tightening portion 2100 such that the first fastener channel 2150 is transverse to the central axis 1142 while being in communication with the first partial tightening slot 2140. In the illustrated example, the first fastener channel 2150 extends away from the side 1134 of the receiver body and passes through the first opposing sidewalls 2110, 2120 and into communication with a threaded-member, such as a nut (not shown) or an internally threaded portion and/or reinforced portion within the receiver body 1100.

In at least one example shown in FIG. 2A, the fastener channel 2150, the second fastener channel 2250, the third fastener channel 2350, and the fourth fastener channel 2450 are generally parallel to each other while being transverse and offset from the central axis 1142 while also being normal to a line 1150 that is offset parallel to and offset from the central axis 1142. Further, the line 1150 may also be coincident with central axes of the first, second, third, and fourth fastener channels 2150, 2250, 2350, 2450 while also being coincident with the first, second, third, and fourth partial tightening slots 2140, 2240, 2340, 2440 (FIG. 2B). Accordingly, the line 1150 corresponds to the depth of the fastener channels 2150, 2250, 2350, 2450 where they intersect the first, second, third and fourth partial tightening slots 2140, 2240, 2340, 2440 (still best shown in FIG. 2B). As will be discussed in more detail hereinafter, each of the relief recesses 2500, 2600, 2700, 2800, 2900 each extend to a depth that is nearer the central axis 1142 than the line 1150.

Referring simultaneously to FIGS. 2A and 2B, both the first end relief recess 2500 and the first central relief recess 2600 each extend to a depth within the receiver body 1100, and the bottom portion 1138 in particular, that is relatively nearer the central axis 1142 than the line 1150, and thus the first fastener channel 2250.

The second fastener channel 2250 is defined in the second tightening portion 2200 such that the second fastener channel 2250 is transverse to the central axis 1142 while being in communication with the second partial tightening slot 2240. In the illustrated example, the second fastener channel 2250 extends away from the side 1134 of the receiver body and passes through the second opposing sidewalls 2210, 2220 and into communication with a threaded-member, such as a nut (not shown) or an internally threaded portion and/or reinforced portion within the receiver body 1100. As also shown in FIGS. 2A and 2B, both the first central relief recess 2600 and the second central relief recess 2700 each extend to a depth within the receiver body 1100, and the bottom portion 1138 in particular, that is relatively nearer the central axis 1142 than the line 1150 and thus the second fastener channel 2250.

The third fastener channel 2350 is defined in the third tightening portion 2300 such that the third fastener channel 2350 is transverse to the central axis 1142 while being in communication with the third partial tightening slot 2340. In the illustrated example, the third fastener channel 2350 extends away from the side 1134 of the receiver body and passes through the third opposing sidewalls 2310, 2320 and into communication with a threaded-member, such as a nut (not shown) or an internally threaded portion and/or reinforced portion within the receiver body 1100. As also shown in FIGS. 2A and 2B, both the second central relief recess 2700 and the third central relief recess 2800 each extend to a depth within the receiver body 1100, and the bottom portion 1138 in particular, that is relatively nearer the central axis 1142 than the line 1150 and thus the third fastener channel 2350.

The fourth fastener channel 2350 is defined in the fourth tightening portion 2400 such that the third fastener channel 2450 is transverse to the central axis 1142 while being in communication with the fourth partial tightening slot 2440. In the illustrated example, the fourth fastener channel 2450 extends away from the side 1134 of the receiver body and passes through the fourth opposing sidewalls 2410, 2420 and into communication with a threaded-member, such as a nut (not shown) or an internally threaded portion and/or reinforced portion within the receiver body 1100. As also shown in FIGS. 2A and 2B, both the third central relief recess 2800 and the second end relief recess 2900 each extend to a depth within the receiver body 1100, and the bottom portion 1138 in particular, that is relatively nearer the central axis 1142 than the line 1150 and thus the fourth fastener channel 2450.

Each of the first fastener channel 2150, the second fastener channel 2250, the third fastener channel 2350, and the fourth fastener channel 2450 are configured to receive one of the fasteners 1200 (FIG. 1B) therein to facilitate the coupling of the barrel assembly 120 (also shown in FIG. 1B) to the receiver body 1100. As each fastener 1200 (FIG. 1B) is tightened, the corresponding first, second, third, or fourth partial tightening slot 2140, 2240, 2340, 2440 is narrowed, thereby causing the barrel receiving recess 1140 in that area to constrict as well, causing the associated first, second, third, or fourth barrel-tightening portion 2100, 2200, 2300, 2400 to tighten onto the barrel 120 (FIG. 1B).

As show in FIG. 2B, each of the first, second, third, and fourth relief recesses 2500, 2600, 2700, 2800, 2900 are sized to allow each of the barrel-tightening portions 2100, 2200, 2300, 2400 to work in a relatively independent manner by reducing the amount of material that would otherwise be deflected as the fasteners (1200 FIG. 1B) are tightened to the receiver body 1100. Reducing the amount of material that is deflected in the areas near or between the barrel-tightening portions 2100, 2200, 2300, 2400 as the fasteners (1200, FIG. 1B) are tightened to the receiver body 1100 in turn reduces the stress that would otherwise be transferred to those areas near or between the barrel-tightening portions 2100, 2200, 2300, 2400, which in turn reduces stress that may otherwise by transferred to other barrel-tightening portions 2100, 2200, 2300, 2400, thereby allowing each of the barrel-tightening portions 2100, 2200, 2300, 2400 to function independently.

Particularly, each of the first, second, third, and fourth barrel-tightening portions 2100, 2200, 2300, 2400 have a corresponding first, second, third, and fourth fastener engagement surface 2160, 2260, 2360, 2460 against which the fasteners 1200 (FIG. 1B) abut. In at least one example, each of the first, second, third, and fourth relief recesses 2100, 2200, 2300, 2400 extend transversely from the line 1150 further than the fastener engagement surfaces 2160, 2260, 2360, 2460 to which they are adjacent. In at least one example, the fastener engagement surfaces 2160, 2260, 2360, 2460 are recessed within the side portion 1134 by fastener head recesses 2170, 2270, 2370, 2470.

Figure 2C:
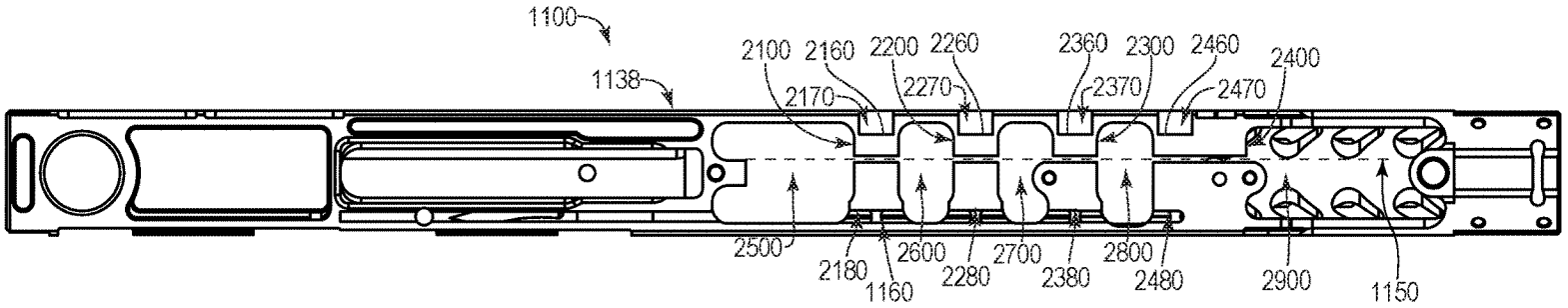
FIG. 2C illustrated a bottom view of the receiver body of the firearm shown in FIG. 2A.

As shown in FIG. 2C, opposite the fastener engagement surfaces 2160, 2260, 2360, 2460, a slot 1160 is defined in the bottom portion 1138 of the receiver body 1100. The slot 1160 defines the first, second, third, or fourth transverse fastener ends 2180, 2280, 2380, 2480 of the associated first, second, third, and fourth tightening portions 2100, 2200, 2300, 2400. As shown in FIG. 2C, the relief recesses 2500, 2600, 2700, 2800, 2900 extend transversely from the line 1150 further first, second, third, or fourth transverse fastener ends 2180, 2280, 2380, 2480 to which they are adjacent.

The first, second, third and fourth tightening portions 2100, 2200, 2300, 2400 have a corresponding first, second, third, or fourth transverse tightening length. The first, second, third, and fourth transverse tightening lengths may also be described as the distance between those portions of the first, second, or third barrel-tightening portions 2100, 2200, 2300, 2400 on which compressive forces act to selectively narrow the first, second, third or fourth partial tightening slots 2150, 2250, 2350, 2450 when the fasteners 1200 (FIG. 1B) are tightened. In the illustrated example, the first, second, third, or fourth transverse tightening length are readily measured between the applicable first, second, third, and fourth fastener engagement surface 2160, 2260, 2270, 2280 and the corresponding first, second, third, and fourth transverse end 2180, 2280, 2380, 2480 as measured normal to the line 1150. It will be appreciated that in other examples, various transverse tightening lengths may be described with reference to an opposing fastener engagement surface or feature, such as a nut on one surface or an embedded nut or other similar device (not shown).

The first end relief recess 2500, the first central relief recess 2600, the second central relief recess 2700, and the third central relief recess 2800, and the second end relief recess 2900 may also be described as having a first, second, third, fourth and fifth transverse relief width as measured normal to the line 1150. In such an example, the first and second transverse relief widths are greater than the first transverse tightening length, the second and third transverse relief widths are greater than the second tightening length, the third and fourth transverse relief widths are greater than the third transverse tightening length, and the fourth and fifth transverse relief widths are greater than the fourth transverse tightening length. In some examples, any one of the transverse relief widths may be infinitely longer than an adjacent transverse tightening length if the relief recess extends through the entire width of the bottom portion 1138 of the receiver body 1100. In the present example, the first, second, third, fourth, and fifth transverse relief widths are described as being greater than the first, second, third, and fourth transverse tightening lengths, though it will be appreciated that the first, second, third, fourth, and fifth transverse relief widths may be equal to the first, second, third, and fourth transverse tightening lengths, or that the first, second, third, fourth, and fifth transverse relief widths may be less than the first, second, third, and fourth transverse tightening lengths provided they provide relatively even deflection (and thus relatively even clamping forces) that vary less than 5%, such as about %3 or less variance about a mean deflection across the partial tightening slots at a given torque load. For example, the first, second, third, fourth, and fifth transverse relief widths may be approximately eighty percent (80%) of the first, second, third, and fourth transverse tightening lengths according to one example.

Such a configuration may further allow the barrel-tightening portions 2100, 2200, 2300, 2400 to function independently by removing material directly adjacent to the fastener engagement surfaces 2160, 2260, 2360, 2460 to reduce the amount of material that would otherwise be deflected or displaced when tightening the fasteners 1200 (FIG. 1B). Removing material transversely near or beyond the fastener engagement surfaces 2160, 2260, 2360, 2460 acts to reduce the transverse component of the material deflected as the barrel-tightening portions 2100, 2200, 2300, 2400 cooperate with the fasteners 1200 (FIG. 1B).

As previously introduced, the receiver body 1100 is configured such that a given torque applied to the fasteners 1200 (FIG. 1B) will result in substantially similar deflection of the receiver body 1100 adjacent the fasteners 1200, which may result in relatively even strain within the receiver body 1100, including the first, second, third, and fourth barrel-tightening portions 2100, 2200, 2300, 2400 and areas of the receiver 1100 adjacent those portions, while transmitting even clamping forces to the barrel assembly 110 (FIG. 1B). Relatively even clamping forces have been shown to improve the accuracy of such a firearm while relatively even strain within the receiver body 1100 may also improve the longevity of the receiver body 1100 by reducing stress risers or spikes. Accordingly, the configuration and interaction of the first, second, third, and fourth tightening portions 2100, 2200, 2300, 2400 and the relief recesses 2500, 2600, 2700, 2800, 2900 allow for relatively even clamping forces on the barrel assembly 120.

Figure 3:
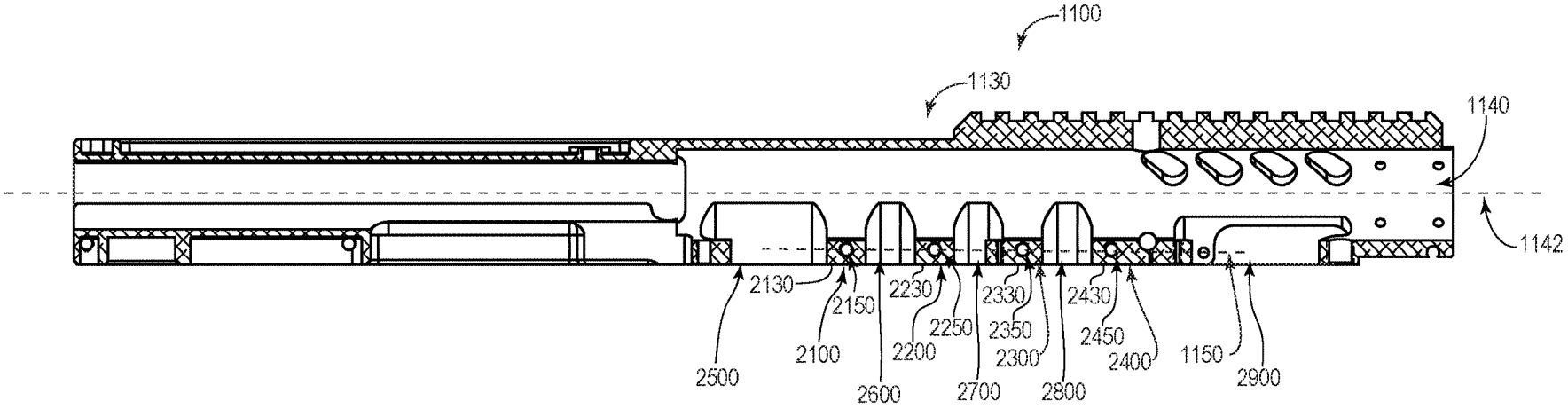
FIG. 3 is a section view of the receiver body of FIG. 2A taken along section 3-3 shown in FIG. 2A.

FIG. 3 is a cross-sectional view of the receiver body 1100 showing such a configuration in more detail. As illustrated in FIG. 3, the first end relief recess 2500, the first central relief recess 2600, the second central relief recess 2700, the third relief recess 2800, and the second end relief recess 2900 extend beyond line 1150, and thus beyond first fastener channel 2150, the second fastener channel 2250, the third fastener channel 2350, and the fourth fastener channel 2450. In at least one example, the first end relief recess 2500, the first central relief recess 2600, the second central relief recess 2700, the third relief recess 2800, and the second end relief recess 2900 are in communication with the barrel receiving opening 1142.

As shown in FIG. 3, the first end relief recess 2500 and first central relief recess 2600 each extend deeper into the outer portion 1130 of the receiver body 1100 relative to the first outer tightening portion 2130 than the first fastener channel 2150. Similarly, the first central relief recess 2600 and the second central relief recess 2700 extend deeper into the outer portion 1130 of the receiver body 1100 relative to the second outer tightening portion 2230 than the second fastener channel 2250.

The second central relief recess 2700 and the third central relief recess 2800 each extend deeper into the outer portion 1130 of the receiver body 1100 relative to the third outer tightening portion 2330 than the third fastener channel 2350. The third central relief recess 2800 and the second end relief recess 2900 extend deeper into the outer portion 1130 of the receiver body 1100 relative to the fourth outer tightening portion 2430 than the fourth fastener channel 2450. Such a configuration provides depth to allow the first opposing sidewalls 2110, 2120 (FIG. 2B), the second opposing sidewalls 2210, 2220 (FIG. 2B), the third opposing sidewalls 2310, 2320 (FIG. 2B), and the fourth opposing sidewalls 2410, 2420 (FIG. 2B) to move with respect to each other independently.

The lengths of the first barrel-tightening portion 2100, the second barrel-tightening portion 2200, the third barrel-tightening portion 2300, and the fourth barrel-tightening portion 2400 relative to adjacent relief recesses may also facilitate independent movement of the first opposing sidewalls 2110, 2120 (FIG. 2B), the second opposing sidewalls 2210, 2220 (FIG. 2B), the third opposing sidewalls 2310, 2320 (FIG. 2B), and the fourth opposing sidewalls 2410, 2420 (FIG. 2B) with respect to each other.

In particular, the first barrel-tightening portion 2100 may be described as having a first reinforcement length, the second barrel-tightening portion 2200 a second reinforcement length, the third barrel-tightening portion 2300 a third reinforcement length and the fourth barrel-tightening portion a fourth reinforcement length, each being measured relative to the line 1150, which is parallel to the central axis 1142.

In a similar manner, the first relief end recess 2500 may be described as having a first relief distance, the first central relief recess 2600 a second relief distance, the second central relief recess 2700 a third relief distance, the third central relief recess 2800 a fourth relief distance, and the second end relief recess 2900 a fourth relief distance, each being measured relative to the line 1150, which is parallel to the central axis 1142.

In some examples, each of the relief distances for the relief recesses 2500, 2600, 2700, 2800, 2900 are greater than one-fourth (25%) the reinforcement lengths than the barrel-tightening portion or portions 2100, 2200, 2300, 2400 to which the relief recesses 2500, 2600, 2700, 2800, 2900 are adjacent. In further examples, each of the relief distances for the relief recesses 2500, 2600, 2700, 2800, 2900 are greater than four-fifths (80%) the reinforcement lengths than the barrel-tightening portion or portions 2100, 2200, 2300, 2400 to which the relief recesses 2500, 2600, 2700, 2800, 2900 are adjacent. In still further examples, each of the relief distances for the relief recesses 2500, 2600, 2700, 2800, 2900 are greater than four-fifths (80%) the reinforcement lengths than the barrel-tightening portion or portions 2100, 2200, 2300, 2400 to which the relief recesses 2500, 2600, 2700, 2800, 2900 are adjacent.

Such configurations may correspond to ratios for each of the relief distances (corresponding to the relief recesses 2500, 2600, 2700, 2800, 2900) relative to the reinforcement lengths (corresponding to the barrel-tightening portion or portions 2100, 2200, 2300, 2400) to which the relief recesses 2500, 2600, 2700, 2800, 2900 are adjacent each being greater than 1:4 or 0.25 in some examples, greater than 1:3 or 0.33 in further examples, greater than 2:5 or 0.40 in still further examples, such as equal to or greater than 9:20 or 0.45.

Accordingly, if the first tightening portion length was approximately 0.80 inches, each of the first relief distance and the second relief distance would be greater than 0.20 inches in some examples, greater than about 0.264 inches in further examples, and greater than 0.64 inches in still further examples, such as greater than about 0.675 inches.

Similarly, if the second reinforcement length were approximately 0.80 inches, each of the second relief distance and the third relief distance would be greater than 0.20 inches in some examples, greater than about 0.264 inches in further examples, and greater than 0.64 inches in still further examples, such as greater than about 0.675 inches.

If the third reinforcement length were approximately 0.80 inches, each of the third relief distance and the fourth relief distance would be greater than 0.20 inches in some examples, greater than about 0.264 inches in further examples, and greater than 0.64 inches in still further examples, such as greater than about 0.675 inches.

Finally, if the fourth reinforcement portion length were approximately 0.80 inches, each of the fourth relief distance and the fifth relief distance would be greater than 0.20 inches in some examples, greater than about 0.264 inches in further examples, and greater than 0.64 inches in still further examples, such as greater than about 0.675 inches.

Figure 4:
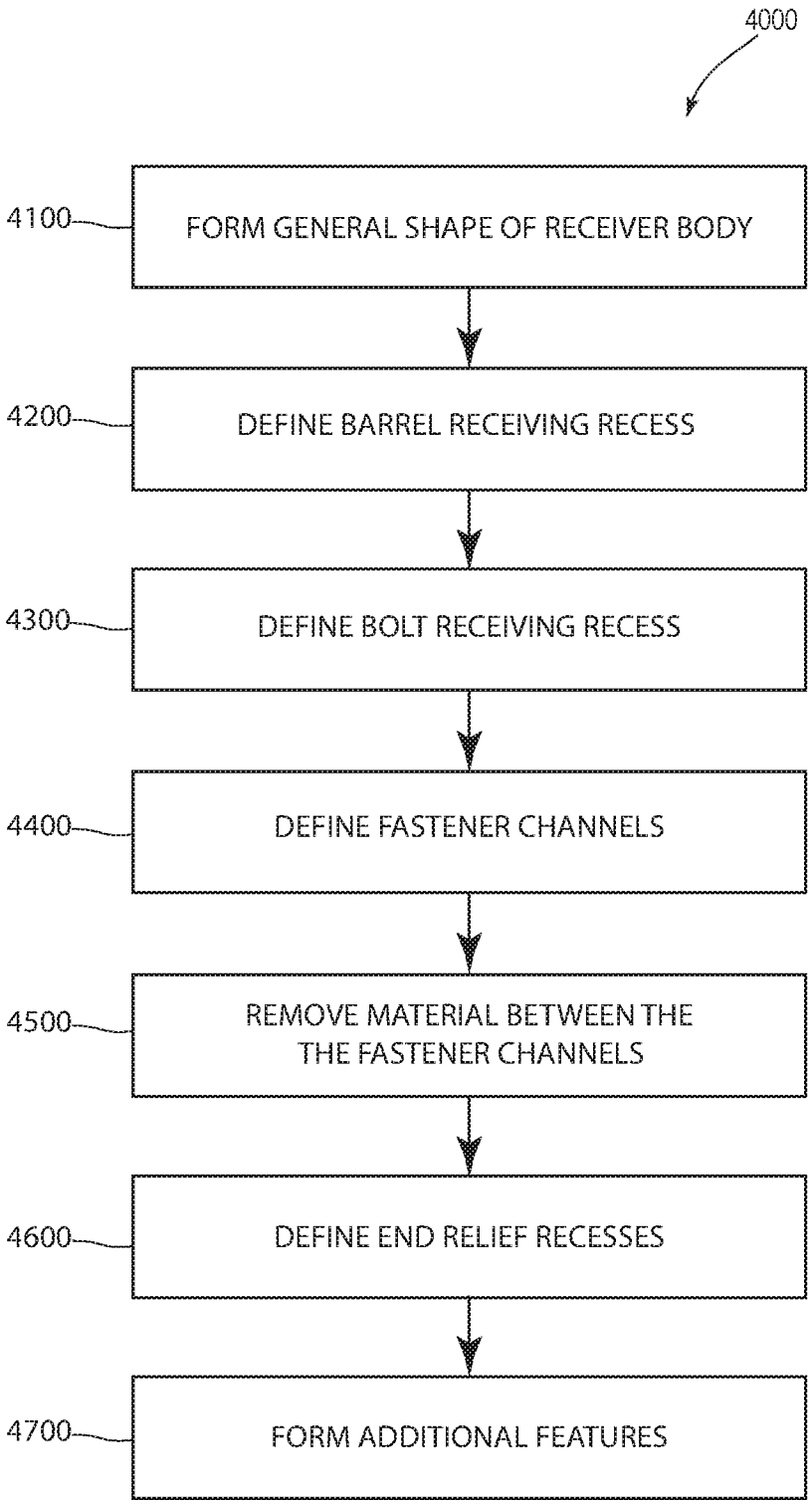
FIG. 4 is a flowchart showing a method of forming a firearm receiver.

FIG. 4 is a flowchart illustrating a method 4000 of forming a firearm receiver according to one example. Referring simultaneously to FIGS. 2B and 4, the method begins at step 4100 by forming the general shape of the receiver body 1100. In at least one example, the general shape of the receiver body 1100 is formed by extruding a general cross-sectional shape of the receiver body (1100; FIG. 3), though the general shape of the receiver body (1100 may be formed by other methods or combinations thereof, such as through forging, machining or other suitable methods. Forming the general shape of the receiver body 1100 generally shapes the receiver body 1100 to form the top portion 1132, side portions 1134, 1136, and the bottom portion 1138.

Thereafter, at step 4200 a barrel receiving recess 4200 is defined in the receiver body 1100. In at least one example, the barrel receiving recess defines the central axis 1142 and serves as a barrel bore around which the orientation and alignment of the rest of the receiver body 1100 depends.

At step 4300, a bolt receiving recess 1144 is formed in the receiver body 1100 such that the bolt receiving recess 1144 is in communication with the barrel receiving recess 1142.

At step 4300 a tightening slot is then formed in the receiver body 1100, which may include the first, second, third, and fourth partial tightening slots 2140, 2240, 2340, 2440. In at least one example, the first, second, third, and fourth partial tightening slots 2140, 2240, 2340, 2440 are part of a single tightening slot that extends from the bottom portion 1138 of the receiver body 1100 and into communication with the barrel receiving recess 1140 while also being parallel to the central axis 1142. In at least one example, the first, second, third, and fourth partial tightening slots 2140, 2240, 2340, 2440 are each coincident the line 1150.

The method 4000 continues at step 4400 with defining plurality of fastener channels in the receiver body 1100, including the first fastener channel 2150, the second fastener channel 2250, the third fastener channel 2350, and the fourth fastener channel 2450. In the illustrated example, each of the first fastener channel 2150, the second fastener channel 2250, the third fastener channel 2350, and the fourth fastener channel 2450 are formed in the side 1134 of the receiver body 1100 near the bottom portion 1138 of the receiver body 1100. In at least one example, the fastener channels 2150, 2250, 2350, 2450 may be formed by milling or drilling techniques.

Further, the first fastener channel 2150 is in communication with the first partial tightening slot 2140, the second fastener channel 2250 is in communication with the second partial tightening slot 2240, the third fastener channel 2350 is in communication with the third partial tightening slot 2340, and the fourth fastener channel 2450 is in communication with the fourth partial tightening slot 2440 while each of the fastener channels is transverse to the central axis 1142. In at least one example, the first, second, third, and fourth fastener channels 2150, 2250, 2350, 2450 are each coincident with the line 1150. In at least one example, the distance or length between the first fastener channel 2150 and the second fastener channel 2250 as measured along line 1150 otherwise being measured parallel to the central axis 1142 may be referred to as a first-to-second fastener length, the distance or length between the second fastener channel 2250 and the third fastener channel 2350 as measured along line 1150 otherwise being measured parallel to the central axis 1142 may be referred to as a second-to-third fastener length, the distance or length between the third fastener channel 2350 and the fourth fastener channel 2450 as measured along line 1150 otherwise being measured parallel to the central axis 1142 may be referred to as the third-to-fourth fastener length.

The method 4000 continues at step 4500 by removing material from the receiver body 1100 and the bottom portion 1138 in the illustrated example between the fastener channels, 2150, 2250, 2350, 2450 to form the first, second, and third central recesses 2600, 2700, 2800. The remaining tightening portions of the receiver body 1100 through which the fastener channel 2150, 2250, 2350, 2450 are defined, include the first, second, third, and fourth tightening portions 2100, 2200, 2300, 2400.

The amount of material removed on either axial side of each fastener channel 2150, 2250, 2350, 2450 is sufficient to facilitate independent movement of the first opposing sidewalls 2110, 2120, the second opposing sidewalls 2210, 2220, the third opposing sidewalls 2310, 2320, and the fourth opposing sidewalls 2410, 2420 with respect to each other.

Removing sufficient material includes relieving or removing material to form a relief recess along at least 25% of the portion of the line 1150 between each of the fastener channels 2150, 2250, 2350, 2450 in some examples, at least 33% in further examples, and at least 45% in yet further examples. In such examples, each of the relief recesses 2500, 2600, 2700, 2800, 2900 may have a width that is greater than the width of adjacent partial tightening slots 2150, 2250, 2350, 2450 (as applicable). More specifically, the relief recesses 2500, 2600, 2700, 2800, 2900 may have the relative widths described elsewhere herein.

The method 4000 also includes define end relief recesses at step 4600. Forming end relief recesses at step 4600 includes forming a proximal end relief recess, labeled as a first end relief recess 2500 proximally of the most proximal fastener channel 2150 and a distal end relief recess labeled as second end relief recess 2900 distally of the most distal fastener relief channel 2450. The proximal end relief recess is at least as long the central relief recess that is distal of the fastener channel to which the proximal end relief recess is adjacent. In the illustrated example, the first end relief recess 2500 has an axial length as measured along line 1150 otherwise being measured parallel to the central axis 1142 that is at least as long as the first central relief recess 2600. Similarly, the distal end relief recess is at least as long as the central relief recess that is proximal of the most distal fastener channel 2450.

In the illustrated example, the second end relief recess 2900 has an axial length as measured along line 1150 otherwise being measured parallel to the central axis 1142 that is at least as long as the third central relief recess 2800. The lengths and dimensions of the relief recesses 2150, 2250, 2350, 2450 may also be formed according to the method 4000 while having the dimensions and relationships set forth above with reference to FIGS. 2A and 2B.

As previously introduced, the relief recesses relieve material to a depth that is deeper than the depth of the fastener channels 2150, 2250, 2350, 2450. In some examples, the relief recesses 2500, 2600, 2700, 2800, 2900 remove material to place the relief recesses 2500, 2600, 2700, 2800, 2900 into communication with the barrel receiving recess 1140.

The method 4000 also includes forming additional features at step 4700. Forming additional features may include forming and/or refining the cuts, slots, rails, or other features shown in the figures which are not otherwise detailed or described with respect to the detailed description. Though a particular order is specified in the method 4000 described above, it will be appreciated that the steps may be performed in different orders, some steps may be performed simultaneously, and/or some steps may be omitted.

Receiver assemblies, receiver bodies, firearm incorporating the like and methods of forming the same are provided herein. The receiver body is configured to allow the barrel-tightening portions to function relatively independently of each other. In particular, the relief recesses result in voids near the barrel-tightening portions to reduce the amount of material that is deflected as the barrel-tightening portions are engaged (with a corresponding reduction in stress) while still providing sufficient reinforcement for the fasteners to provide the desired clamping force on the barrel. Reducing the amount of material deflected to engage the barrel-tightening portions reduces the stress transmitted to adjacent regions thereby providing relatively even clamping forces across the barrel-tightening portions at a given torque loading on the fasteners. Similarly, since the relief recesses reduce the deflection and strain transmitted to those regions near or adjacent the barrel-tightening portions, more of the force and torque used to engage the barrel-tightening portions acts therethrough, resulting in higher barrel clamping forces for given torque loads. Simultaneously increasing the clamping force applied by each barrel-tightening portion while also evening the clamping force applied by each barrel-tightening portion for the same applied torque has shown significant improvement in the accuracy of firearms making use of such receivers.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A firearm receiver, comprising:

a receiver body having a proximal end, a distal end, and a barrel receiving recess defined in the distal end and extending proximally therefrom, the barrel receiving recess defining a central axis, the receiver body further including:

a first barrel-tightening portion formed on an outer portion of the body, the first barrel-tightening portion having a first partial tightening slot defined therein, the first partial tightening slot being in communication with the barrel receiving recess and having first opposing sidewalls, a second barrel-tightening portion formed on an outer portion of the body, the second barrel-tightening portion having a second partial tightening slot defined therein, the second partial tightening slot being in communication with the barrel receiving recess and having second opposing sidewalls, a first relief recess defined in the outer portion of the receiver body at least partially between the first barrel-tightening portion and the second barrel-tightening portion, the first relief recess being in communication with each of the first partial tightening slot and the second partial tightening slot, the first relief recess being wider than both the first partial tightening slot and the second partial tightening slot, a second relief recess defined in the outer portion of the receiver body proximally of the first barrel-tightening portion, the second relief recess being in communication with the first partial tightening slot and being wider than the first partial tightening slot, and a third relief recess defined in the outer portion of the receiver body distally of the second barrel-tightening portion, the third relief recess being in communication with the second partial tightening slot and being wider than the second partial tightening slot, wherein the first relief recess, the second relief recess, and the third relief recess are sized to allow the first opposing sidewalls to move relative to each other independently of movement of the second opposing sidewalls relative to each other.

2. The firearm receiver of claim 1, wherein a first fastener channel is also defined in the first barrel-tightening portion such that the first fastener channel is transverse to and extends through the opposing first opposing sidewalls and a second fastener channel is defined in the second barrel-tightening portion such that second first fastener channel is transverse to and extends through the second opposing sidewalls, wherein the first relief recess has a first relief length as measured along a line parallel to the central axis, the second relief recess has a second relief length as measured along the line parallel to the central axis, the third relief recess has a third relief length as measured along the line parallel to the central axis, and a first fastener separation length is defined between a center of the first tightening portion and a center of the second tightening portion as measured along the line parallel to the central axis, wherein ratios for each of the first relief length, the second relief length, and the third relief length to the first fastener separation length is greater than 1:3.

3. The firearm receiver of claim 2, wherein the ratio between each of the first relief length, the second relief length, and the third relief length to the first fastener separation length is greater than 2:5.

4. The firearm receiver of claim 3, wherein the ratio between each of the first relief length, the second relief length, and the third relief length relative to the first fastener separation length is greater than 0.45.

5. The firearm receiver of claim 2, wherein the first tightening portion includes a first fastener engagement surface configured to have a first fastener abut thereto when the first fastener is coupled to the first tightening portion and the second tightening portion includes a second fastener engagement surface configured to have a second fastener abut thereto when the second fastener is coupled to the first tightening portion, wherein the first relief recess extends farther from the line parallel to the central axis than each of the first fastener engagement surface and the second fastener engagement surface, wherein the second relief recess extends farther from the line parallel to the central axis than first fastener engagement surface, and the third relief recess extends farther from the line parallel to the central axis than the second fastener engagement surface.

6. The firearm receiver of claim 2, wherein first tightening portion has a first transverse tightening length, the second tightening portion has a second transverse tightening length, the first relief recess has a first transverse relief width, the second relief recess has a second transverse relief width, and the third relief recess has a third transverse relief width each being measured normal to the line parallel to the central axis, wherein the first transverse relief width is greater than each of the first transverse tightening length and the second transverse tightening length, the second transverse relief width is greater than the first transverse tightening length, and the third transverse relief width is greater than the second transverse tightening length.

7. A firearm receiver, comprising:

a receiver body having a proximal end, a distal end, and a barrel receiving recess defined in the distal end and extending proximally therefrom, the barrel receiving recess defining a central axis, the receiver body further including:

a first barrel-tightening portion formed on an outer portion of the body, the first barrel-tightening portion having a first partial tightening slot defined therein, the first partial tightening slot being in communication with the barrel receiving recess, a second barrel-tightening portion having a formed on an outer portion of the body, the second barrel-tightening portion having a second partial tightening slot defined therein, the second partial tightening slot being in communication with the barrel receiving recess, a first relief recess defined in the outer portion of the receiver body at least partially between the first barrel-tightening portion and the second barrel-tightening portion, the first relief recess being in communication with each of the first partial tightening slot and the second partial tightening slot, the first relief recess being wider than both the first tightening slot and the second partial tightening slot, a second relief recess defined in the outer portion of the receiver body proximally of the first barrel-tightening portion, the second relief recess being in communication with the first partial tightening slot and being wider than the first partial tightening slot, and a third relief recess defined in the outer portion of the receiver body distally of the second barrel-tightening portion, the third relief recess being in communication with the second partial tightening slot and being wider than the second partial tightening slot, wherein first tightening portion has a first transverse tightening length, the second tightening portion has a second transverse tightening length, the first relief recess has a first transverse relief width, the second relief recess has a second transverse relief width, and the third relief recess has a third transverse relief width each being measured normal to a line parallel to the central axis, wherein the first transverse relief width is greater than each of the first transverse tightening length and the second transverse tightening length, the second transverse relief width is greater than the first transverse tightening length, and the third transverse relief width is greater than the second transverse tightening length.

8. The firearm receiver of claim 7, wherein the first tightening portion includes a first fastener engagement surface configured to have a first fastener abut thereto when the first fastener is coupled to the first tightening portion, the first tightening portion also including a first transverse end, the first transverse end being on an opposing side of the first partial tightening slot relative to the first fastener engagement surface, the transverse tightening length being measured between the first fastener engagement surface and the first transverse end, and wherein the first tightening portion includes a second fastener engagement surface configured to have a second fastener abut thereto when the second fastener is coupled to the second tightening portion, the second tightening portion also including a second transverse end, the second transverse end being on an opposing side of the second partial tightening slot relative to the second fastener engagement surface, the transverse tightening length being measured between the second fastener engagement surface and the second transverse end.

9. The firearm receiver of claim 8, further comprising:

a third barrel-tightening portion formed in the outer portion of the receiver body distally of the third relief recess, the third barrel-tightening portion having a third partial tightening slot defined therein, the third partial tightening slot being in communication with the barrel receiving recess and the third relief recess, and a fourth relief recess defined in the outer portion of the receiver body distally of the third barrel-tightening portion, the fourth relief recess being in communication with the third partial tightening slot.

10. The firearm receiver of claim 9, wherein the third barrel-tightening portion has a third reinforcement length as measured parallel to the central axis and the fourth relief recess has a fourth relief length as measured parallel to the central axis, wherein each of the ratios of the first relief length and the second relief length to the first reinforcement length are each greater than 2:5, the ratios of the first relief length and the third reinforcement length to the second reinforcement length are each greater than 2:5, and the ratios of each of the third relief length and fourth relief length relative to the third reinforcement length are each greater than 2:5.

11. The firearm receiver of claim 7, wherein a first fastener channel is also defined in the first barrel-tightening portion such that the first fastener channel is transverse to and extends through the opposing first opposing sidewalls and a second fastener channel is defined in the second barrel-tightening portion such that second first fastener channel is transverse to and extends through the second opposing sidewalls, wherein the first relief recess has a first relief length as measured along a line parallel to the central axis, the second relief recess has a second relief length as measured along the line parallel to the central axis, the third relief recess has a third relief length as measured along the line parallel to the central axis, and a first fastener separation length is defined between a center of the first tightening portion and a center of the second tightening portion as measured along the line parallel to the central axis, wherein ratios for each of the first relief length, the second relief length, and the third relief length to the first fastener separation length is greater than 1:3.

12. The firearm receiver of claim 11, wherein each of the ratios of the first relief length and the second relief length to the first reinforcement length are each greater than 2:5 and the ratios of the first relief length and the third reinforcement length to the second reinforcement length are each greater than 2:5.

13. The firearm receiver of claim 12, wherein each of the first relief recess, the second relief recess, and the third relief recess are in communication with the barrel receiving recess.

14. A method of forming a firearm receiver, comprising:

forming a receiver body having a proximal end and a distal end;

defining a barrel receiving recess in the distal end of the receiver body, the barrel receiving recess extending proximally from the distal end of the receiver body, the barrel receiving recess defining a central axis;

forming a first fastener channel in the receiver body, the first fastener channel being transverse to a line offset from and parallel to the central axis;

forming a second fastener channel in the receiver body at a first fastener separation length from the first fastener channel as measured along the line offset from and parallel to the central axis, the second fastener channel also being transverse to the line offset from and parallel to the central axis; and defining a first relief recess in the receiver body between the first fastener channel and the second fastener channel, the first relief recess having a first relief length as measured along the line offset from and parallel to the central axis, the ratio of the first fastener separation length to the first relief length being greater than 1:4;

defining a second relief recess in the receiver body proximally of the first fastener channel, the second relief recess having a second relief length that is at least as long as the first relief length as measured relative to the line offset from and parallel to the central axis;

defining a third relief recess in the receiver body distally of the second fastener channel, the third relief recess having a third relief length that is at least as long as the first relief length as measured relative to the line offset from and parallel to the central axis; and defining a tightening slot that passes through the central axis and the line offset from and parallel to the central axis, the tightening slot being in communication with the barrel receiving recess, wherein each of the first relief recess, the second relief recess, and the third relief recesses, and the tightening slot are defined in the receiver body so as to be in communication with each other.

15. The method of claim 14, further including forming a first tightening portion at least partially between the first relief recess and the second relief recess, wherein forming the first tightening portion includes forming a first fastener engagement surface configured to have a first fastener abut thereto when the first fastener is coupled to the first tightening portion, the method further including forming a second tightening portion between the first relief recess and the second relief recess, wherein forming the second tightening portion includes forming a second fastener engagement surface configured to have a second fastener abut thereto when the second fastener is coupled to the first tightening portion, wherein the first relief recess extends farther from the line parallel to and offset from the central axis than each of the first fastener engagement surface and the second fastener engagement surface, wherein the second relief recess extends farther from the line offset from and parallel to the central axis than first fastener engagement surface, and the third relief recess extends farther from the line parallel to the central axis than the second fastener engagement surface.

16. The method of claim 14, further including forming a first tightening portion at least partially between the first relief recess and the second relief recess, wherein forming the first tightening portion includes forming a first fastener engagement surface configured to have a first fastener abut thereto when the first fastener is coupled to the first tightening portion, the method further including forming a second tightening portion between the first relief recess and the second relief recess, wherein forming the second tightening portion includes forming a second fastener engagement surface configured to have a second fastener abut thereto when the second fastener is coupled to the first tightening portion, wherein the first tightening portion has a first transverse tightening length, the second tightening portion has a second transverse tightening length, the first relief recess has a first transverse relief width, the second relief recess has a second transverse relief width, and the third relief recess has a third transverse relief width each being measured normal to the line parallel to the central axis, wherein the first transverse relief width is greater than each of the first transverse tightening length and the second transverse tightening length, the second transverse relief width is greater than the first transverse tightening length, and the third transverse relief width is greater than the second transverse tightening length.

17. The method of claim 14, wherein the first relief recess is defined in the receiver body such that the ratio of the first fastener separation length to the first relief length is greater than 2:5.

18. The method of claim 14, wherein the first relief recess is defined in the receiver body such that the ratio of the first fastener separation length to the first relief length is greater than 0.45.

* * * * *